US005810402A

United States Patent [19]

Armstrong

[11] Patent Number: 5,810,402

[45] Date of Patent: Sep. 22, 1998

[54] ADJUSTABLE INTERCONNECTED LOCK

[75] Inventor: Steven Armstrong, Yorba Linda, Calif.

[73] Assignee: Emhart Inc., Newark, Del.

[21] Appl. No.: 694,978

[22] Filed: Aug. 9, 1996

[51] Int. Cl.[6] ..... E05C 1/12

[52] U.S. Cl. ..... 292/39; 292/172; 292/DIG. 60

[58] Field of Search ..... 292/336.3, 39, 292/142, 172, DIG. 60; 70/107

[56] References Cited

U.S. PATENT DOCUMENTS

| | | | |
|---|---|---|---|
| 2,862,750 | 12/1958 | Minke | 292/336.3 X |
| 3,791,180 | 2/1974 | Doyle | 292/39 X |
| 4,725,085 | 2/1988 | Hu et al. | 292/172 |
| 4,809,526 | 3/1989 | Shen | 70/107 |
| 4,934,800 | 6/1990 | Choi | 292/172 |
| 5,513,505 | 5/1996 | Danes | 292/DIG. 60 X |

*Primary Examiner*—Rodney M. Lindsey
*Attorney, Agent, or Firm*—Spencer T. Smith

[57] ABSTRACT

An interconnected lock is disclosed which can be used in applications which have differing center distances. A rack is located between the lower operator assembly and the upper deadbolt for engaging a pinion which will release the deadbolt. This pinion can be vertically located at a position to receive the drive spindle of the deadbolt. A second pinion which is secured to the turn lever for the deadbolt is secured to the faceplate. These pinions cooperate with adjacent width portions of the rack enabling the faceplate to operate with different center distances.

2 Claims, 2 Drawing Sheets

ADJUSTABLE INTERCONNECTED LOCK

The present invention relates to interconnected locks (handlesets) which have an upper deadbolt and a lower lockset having interior and exterior operators. The interior operator of the handleset can be rotated from a closed position to an open position to release the lower lockset and the upper deadbolt and lower lockset are interconnected so that rotation of the interior operator to the open position will also release the deadbolt.

The vertical distance between the deadbolt and lockset axes is referred to as the center distance and a lockset conventionally can only be used on a selected center distance.

It is accordingly an object of the present invention to provide a handleset which can be used for any center distance within a substantial center distance range.

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings.

Figure 2:
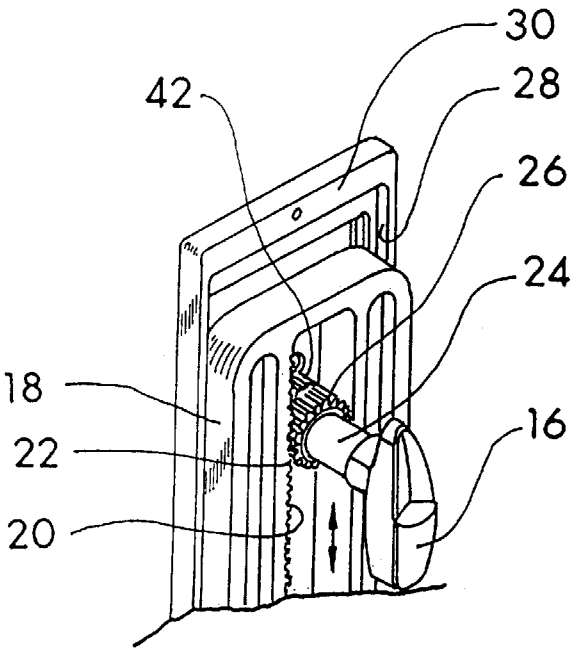
FIG. 2 is an oblique view of the upper portion of the lock shown in FIG. 1 with the faceplate removed.
Figure 1:
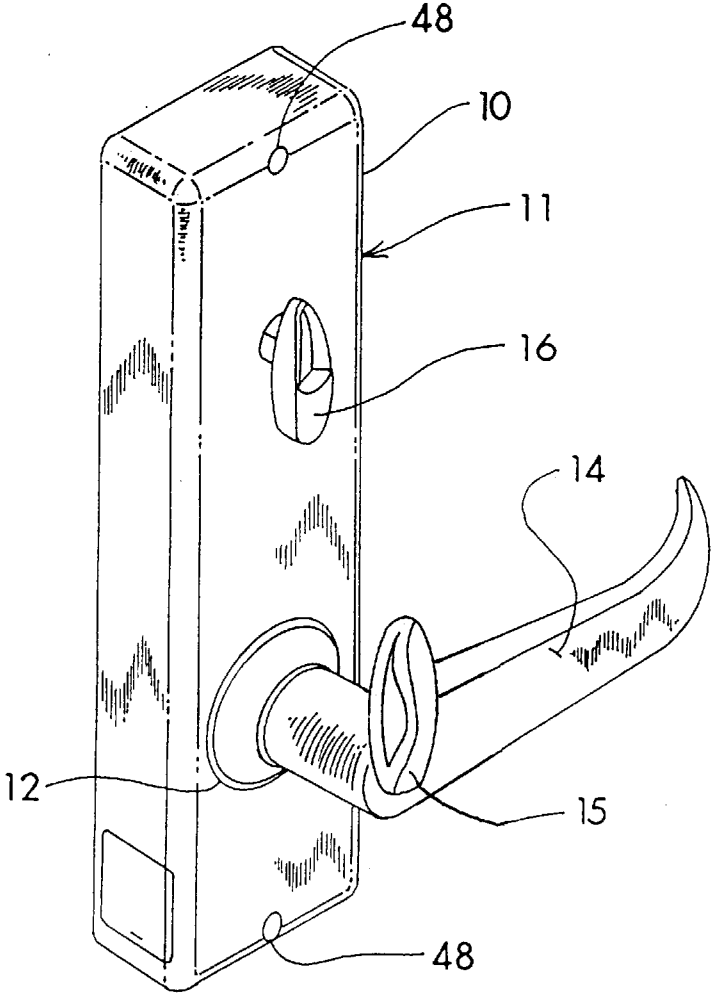
FIG. 1 is an oblique view of the portion of an interconnected lock which is secured to the inside of a door.
Figure 4:
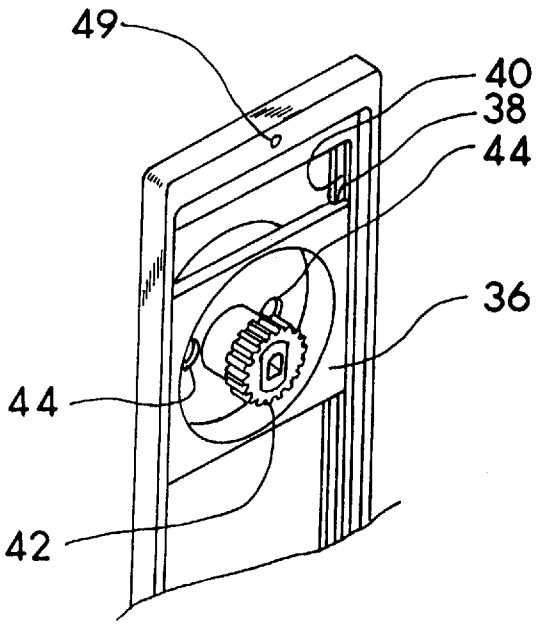
FIG. 4 is an oblique view similar to FIG. 2, with the turn lever and rack removed.
Figure 3:
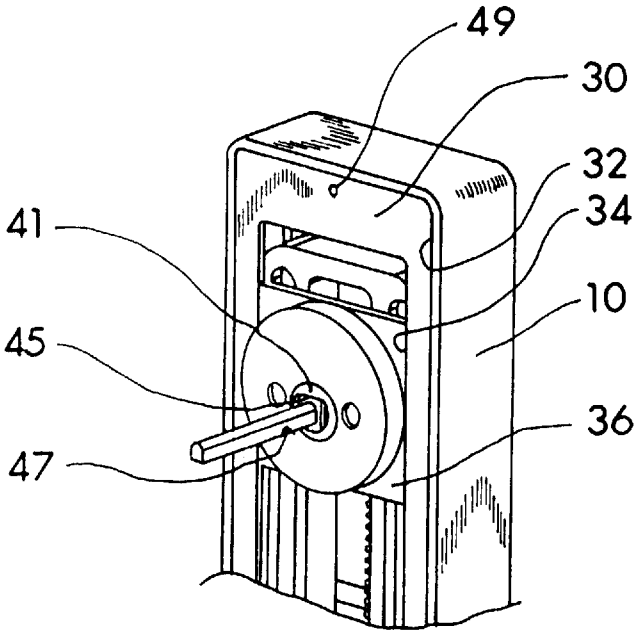
FIG. 3 is an oblique rear view of the upper portion of the lock shown in FIG. 1.

As seen from the inside of the door, the interior faceplate 10 of the handleset 11 has a lower lockset 12 which includes a rotatable interior operator (knob or lever 14) including a locking lever 15. The door can be secured by rotating the turn lever 16 of the deadbolt 90 degrees to the illustrated vertical position which fully advances the bolt of the deadbolt. Rotation of the interior operator vertically displaces a rack 18 (FIG. 2) which has teeth 20 on an interior vertical surface 22. The disclosed invention can be used on the handleset shown in U.S. Pat. No. 5,496,082, which issued on Mar. 5, 1996. The turn lever 16 is fastened to a shaft 24 which terminates with a pinion 26 which will operatively engage with the rack teeth 20. The thickness of the pinion is about one half the thickness of the rack 18 and accordingly the pinion cooperates with the interior half (half of the width) of the rack. Since the turn lever is mounted on the interior faceplate 10, the location of the pinion relative to the rack, at its neutral position, will always be the same. Movement of the rack is guided by suitable tracks 28 defined in a frame 30 which is received by a pocket 32 defined in the back of the interior faceplate 10 (FIG. 3).

The frame has an elongated vertically extending opening 34 which receives a slide 36. The slide has interior side grooves 38 which cooperate with opposed frame flanges 40. This slide rotatably supports a shaft 41 having a second pinion 42 secured to its free end. The slide shaft pinion 42 has a thickness about half the thickness of the rack so that it will cooperate with the exterior half of the rack (half of the width). The slide has a pair of holes 44 through which suitable screws (not shown) can extend to secure the slide to the exterior deadbolt housing (also not shown). The slide shaft 41 has a hole 45 for receiving the drive spindle 47 of the deadbolt. The location of the slide, and hence the second pinion, will correspond to the actual center distance of the handleset and accordingly can be changed from one center distance to another, within the range provided by the rack. In FIG. 2, the pinions are shown coaxial but this would only be the case for one center distance. For different center distances, these pinions would no longer be coaxial.

To assemble the interior faceplate, the frame would be first secured in position. The slide would be placed in position locating the deadbolt drive spindle within the slide shaft hole and the screws would be introduced into the holes 44 to secure the slide to the deadbolt. The faceplate which supports the turn lever would then be located over the frame, adjusting the turn lever to get the turn lever pinion into the rack teeth. The faceplate would then be secured in position with screws passing through suitable faceplate holes 48 and received by mounting plate holes 49.

I claim:

1. A handleset for a door including an upper deadbolt having an interior turn lever secured to a first rotatable shaft and a rotatable drive spindle, a lower lockset having a rotatable interior operator rotatable about an axis, means for interconnecting said lower operator and said drive spindle so that rotation of said lower operator will rotate said drive spindle to release the deadbolt including a rack having a vertically extending row of teeth, said rack having a selected width, frame means for supporting said rack for vertical displacement, a first pinion secured to said first rotatable shaft operatively engaging a selected vertical portion of said row of teeth, a second pinion secured to a second rotational shaft, a slide member for supporting said second rotational shaft and for receiving said drive spindle, said frame means further comprising means for supporting said slide member for vertical displacement independent of the vertical displacement of said rack with said second pinion operatively engaging a vertical portion of said row of teeth horizontally adjacent the portion engaged by the first pinion, whereby said drive spindle can be located at different center distances from the axis of said lower operator and be interconnected with said turn lever across said rack.

2. A handleset according to claim 1, wherein said first and second pinions each occupy about half of the width of said rack.

* * * * *